US006758555B2

(12) United States Patent
Bajeux

(10) Patent No.: US 6,758,555 B2
(45) Date of Patent: Jul. 6, 2004

(54) PRINTING HEAD AND PRINTER WITH IMPROVED DEFLECTION ELECTRODES

(75) Inventor: Paul Bajeux, Chatuzange le Goubet (FR)

(73) Assignee: Imaje SA, Bourg les Valence Cedex (FR)

( * ) Notice: Subject to any disclaimer, the term of this patent is extended or adjusted under 35 U.S.C. 154(b) by 239 days.

(21) Appl. No.: 10/080,025

(22) Filed: Feb. 21, 2002

(65) Prior Publication Data

US 2002/0118258 A1 Aug. 29, 2002

(30) Foreign Application Priority Data

Feb. 27, 2001 (FR) ..... 01 02638

(51) Int. Cl.[7] ..... B41J 2/09; B41J 2/105
(52) U.S. Cl. ..... 347/77; 347/82
(58) Field of Search ..... 347/73, 21, 74–75, 347/76–77, 78, 79, 80–81, 82

(56) References Cited

U.S. PATENT DOCUMENTS

| | | | | | |
|---|---|---|---|---|---|
| 3,955,203 | A | | 5/1976 | Chocholaty | 347/77 |
| 4,266,231 | A | * | 5/1981 | Drago et al. | 347/76 |
| 4,338,613 | A | | 7/1982 | Cruz-Uribe | 347/82 |
| 4,346,387 | A | * | 8/1982 | Hertz | 347/75 |
| 4,375,062 | A | * | 2/1983 | Sturm | 347/21 |
| 4,845,512 | A | | 7/1989 | Arway | 347/77 |
| 5,070,341 | A | | 12/1991 | Wills et al. | 347/82 |
| 5,337,071 | A | * | 8/1994 | East et al. | 347/77 |
| 5,434,609 | A | * | 7/1995 | Rhodes | 347/77 |

FOREIGN PATENT DOCUMENTS

| | | |
|---|---|---|
| EP | 0 487 259 A | 5/1992 |
| EP | 0 519 403 A2 | 12/1992 |
| EP | 0 606 767 A | 7/1994 |
| EP | 0 803 918 A | 10/1997 |
| FR | 2 374 169 | 10/1977 |
| GB | 2 249 995 A | 5/1992 |
| JP | 10 114 065 A | 5/1998 |
| WO | 89/03768 | 5/1989 |
| WO | 98/55315 | 12/1998 |

* cited by examiner

*Primary Examiner*—Lamson Nguyen
*Assistant Examiner*—K. Feggins
(74) *Attorney, Agent, or Firm*—Pearne & Gordon LLP

(57) ABSTRACT

In a printing head of a printer with deviated continuous jet, one of the electrodes (2) for deviating the ink drops is provided in a downstream part with a longitudinal slit (12) presenting a plane of symmetry relative to a plane containing the axis of the ink jet.

Thus the inter-electrode spacing can be reduced and the voltage present between the electrodes (2, 3) can be lowered without reducing the deflection efficiency.

12 Claims, 6 Drawing Sheets

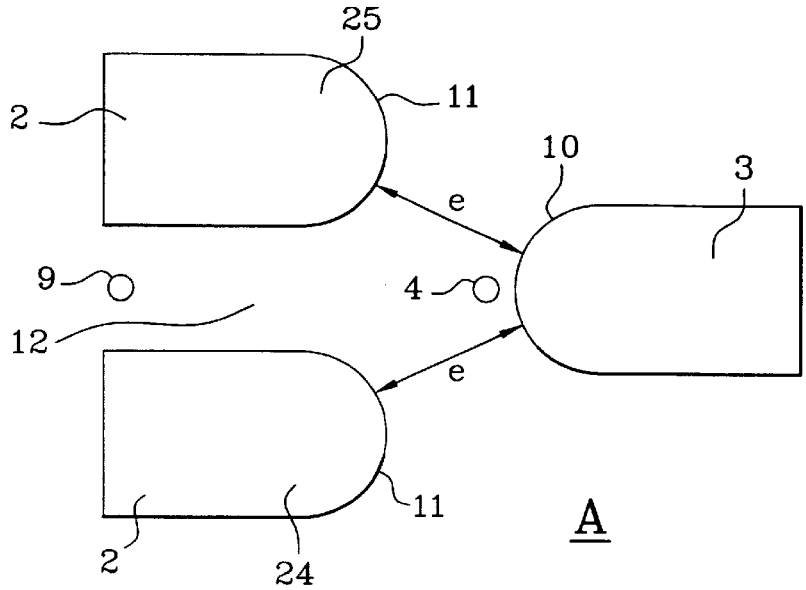
Fig. 6
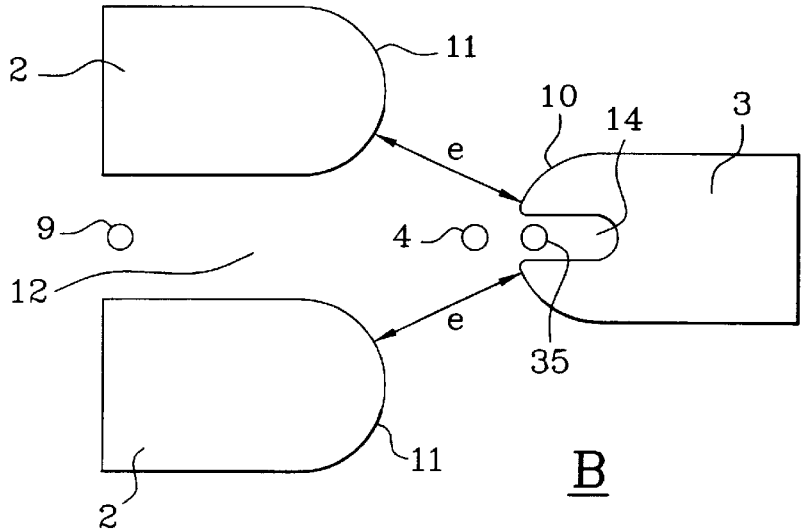

PRINTING HEAD AND PRINTER WITH IMPROVED DEFLECTION ELECTRODES

The present invention relates to the domain of printing heads for printers. It relates in particular to an improvement of electrostatic deflection electrodes for electrically charged ink drops. It also concerns an ink jet printer equipped with this improved head.

STATE OF PRIOR ART

Ink jet printers can be divided into two major technological families, a first constituted of "request drop" printers and a second constituted of continuous jet printers:

The "request drop" printers are essentially office printers, intended for printing a text and graphics, in black and white or in colour.

The "request drop" printers generate directly and uniquely the ink drops needed for the printing of the motives required. The printing head of these printers comprises a plurality of ink ejection nozzles, usually aligned following an alignment axis of the nozzles and each addressing a unique printing support point. When the injection nozzles are sufficient in number, the printing is obtained by simple displacement of the printing support under the head, perpendicularly to the alignment axis of the nozzles. Otherwise, a supplementary sweep of the support relative to the printer head is indispensable.

The continuous ink jet printers are usually used for industrial applications for marking and coding.

The typical function of a continuous ink jet printer can be described as follows. Electrically conducting ink maintained under pressure escapes from a calibrated nozzle, thus forming an ink jet. Under the action of a periodic stimulation device, the ink jet thus formed splits at regular time intervals at a point unique in space. This forced fragmentation of the ink jet is usually induced at a said jet break point by periodic vibrations of a piezoelectric crystal, placed in the ink and upstream of the nozzle. Starting from the break point, the continuous jet transforms into a series of identical ink drops, regularly spaced. Next to the break point a first group of electrodes is placed, called "charge electrodes", whose function is to transfer selectively, and for each drop of the series of drops, a predetermined quantity of electric charge. The group of drops of the jet then crosses a second arrangement of electrodes called "deflection electrodes" forming an electric field which will modify the trajectory of the charged drops.

In a first variant, for printers called deviated continuous ink jet printers, the quantity of charge transferred to the drops of the jet is variable and each drop registers a deflection proportional to the electric charge which has previously been attributed to it. The point of the printing support reached by a drop is a function of this electric charge. The non-deflected drops are recuperated by a gutter and recycled towards an ink circuit.

Those skilled in the art also know that a specific device is required to ensure constant synchronisation between the instants when the jet is broken and the application of the charge signals of the drops. It is to be noted that this technology, thanks to its multiple levels of deflection, makes it possible for a single nozzle to print the integrality of a motive by successive segments, that is to say by lines of points of a given width. The passage from one segment to another takes place by a continuous relative displacement of the substrate compared to the printing head, perpendicular to said segments. For applications requiring a printing width slightly wider than the width of an isolated segment, several mono-nozzle printing heads, typically from 2 to 8, can be grouped together within the same housing.

A second variant of deviated continuous ink jet printers called binary continuous jet printers differ mainly from the above in that a single deflection level is created for the drops. The printing of letters or motives therefore needs the use of multi-nozzle printing heads. The centre distance between the nozzles coincides with that of the impacts on the printing support. It is to be noted that generally the drops destined for printing are the non-deflected drops. The binary continuous jet printers are intended for high speed printing applications such as addressing or personalisation of documents.

It should be emphasised that the continuous jet technique requires pressurisation of the ink, thus allowing a printing distance, that is to say the distance between the lower face of the printing head and the printing support, able to reach 20 mm, or ten to twenty times greater than the printing distances of request drop printers.

Those skilled in the art insist on optimising the performances of the layout of the deflection electrodes following two techniques.

These techniques are shown diagrammatically in FIGS. 1 to 4 in the appendix.

The first deflection technique, so-called equipotential, is the oldest. It consists of using two metallic electrodes with surfaces facing each other—called active surfaces—. The series of drops crosses the space comprised between the active surfaces. Each of the active surfaces, relative to the jet, is raised to a constant and uniform electric potential. Two embodiments are used in particular.

The first embodiment is shown in FIG. 1.

A printer comprises a reservoir 111 containing electrically conductive ink 110 which is distributed by a distribution channel 113 towards a drop generator 116. The drop generator 116, using the ink under pressure contained in the distribution channel 113, forms an ink jet and splits this jet into a series of drops. These drops are electrically charged in a selective way by means of a charge electrode 120 fed by a voltage generator 121. The charged drops pass across a space comprised between two deviation electrodes 2, 3. According to their charge, they are more or less deviated. The drops which are least deviated or non-deviated are directed towards an ink recuperation unit or gutter 6 while the other deviated drops are directed towards a substrate 27 carried locally by a support 13. The successive drops from a burst reaching the substrate 27 can thus be deviated towards a low end position, an high end position, and successive intermediary positions. The drops of the burst as a whole form a line of width $\Delta X$ perpendicular to an advanced position Y relative to the printing head and the substrate. The printing head is formed by the means 116 for generating and slitting the ink jet into drops, the charge electrode 120, the deviation electrodes 2, 3, and the gutter 6. This head is generally enclosed in a housing, not shown. The time between the first and second drop of a burst is very short. The result is that despite continuous movement between the printing head and the substrate, it can be considered that the substrate has not moved relative to the printing head during the time of a burst. The bursts are fired at regularly spaced intervals. The combination of the relative movement of the head and the substrate, and the selection of the drops of each burst directed towards the substrate make it possible to print any motive such as that shown as 28 in FIG. 1. In the following description only the deviation electrodes of the drops of series 1 of drops formed from an ink jet exiting from the nozzle will be considered.

Concerning the deviation of said drops, it is a matter of forming a very strong electric field Ed, by application of a voltage Vd, which is constant between the two electrodes 2, 3 formed by two parallel plates 2, 3. The value of the electric field Ed created between the active surfaces of the electrodes 2, 3 is called optimal when this value is slightly lower, by subtracting a security margin, compared to that of the breakdown field corresponding to the space e between the active surfaces.

Such a concept is characterised by its simplicity but also by numerous inconveniences:

- a high value of e, typically 5 mm, is indispensable for allowing the printing of very wide segments at the usual printing distances. Such a spacing implies the use of a very high value of Vd, about 8 kV, which cannot be generated within the printing head because of lack of space, requires complicated connectics and generally leads to raising each of the electrodes to potentials of opposite signs relative to the reference potential of the ink;
- such a value for the potential difference also makes it necessary to respect the minimum spacing from other metallic elements of the printing head, for example charge electrodes, recuperation gutter or housing, in order to avoid any electrical breakdown. The overall size resulting leads to the path of the drops being lengthened needlessly, and thus the time during which aerodynamic or electrostatic perturbations can act, which is detrimental to the precision of the impacts on the printing support;
- it is known to those skilled in the art that the value of the breakdown field between two electrodes plunged in a gaseous medium such as air, is a decreasing function of the spacing e between the two electrodes. The high value of e characterising this first embodiment and the restrictions relative to avoiding breakdown limit the value of the deflection field Ed to a value lower than the optimum value. The printing of wide segments thus requires high deflection plates, typically 25 mm, so as to obtain the maximum deflection required by the longer action of the electric field. This characteristic also contributes to lengthening the path of the drops towards the printing support.

The second deflection technique, shown diagrammatically in FIG. 2, is differentiated from the above by the fact that at least one part of at least one of the two active surfaces forms a non-zero angle with the ink jet axis 1. The geometry is among that most usually encountered and is very simple. In a part 15 upstream of a layout 20 of two electrodes 2, 3 formed by plates 2, 3, the plates are parallel and spaced by a distance generally less than that adopted in the first embodiment. The electric field in this upstream part, 15, between the two plates 2, 3, then reaches a level at least equal to that of the first mode but for a lower potential difference. Then it becomes necessary, in order to allow printing of wide segments, to avoid the most charged drops, and thus the most deviated, to enter into collision with the electrode 3 towards which they are deviated. The solution retained consists of inclining, relative to the axis of the jet, a downstream part 16 of this electrode 3. It is evident that in the downstream region, the value of the electric field drops very significantly, is no longer optimum, which results in significant lowering of the deflection efficiency. Consequently, the main advantage of the second variant in comparison with the first is to provide almost equivalent performances for a lower potential difference.

One can refer to patent applications WO 89/03768 and WO 98/28148 in order to obtain supplementary details about the incorporation of such deflection devices within binary or deviated continuous ink jet printers. In this latter technology, it can be noted that one of the two deflection electrodes is often suppressed.

The patent application FR 77 33131 proposes a variant, shown in FIG. 3, in which the active surface, towards which the deflection of the drops is oriented, has a double longitudinal and transversal curvature. The convexity resulting from the adoption of these curvatures makes it possible to eliminate any metallic sharp edges and thus to minimise the risks of electric breakdown. The longitudinal curvature of the active face 17 of the electrode 3 also provides improved transition between the upstream region 15 with strong electric field and the downstream region 16 with low electric field.

In order to maintain optimum deflection efficiency all along the path of the drops, a second technical path, so-called "non-equipotential" has been thought of, in which at least one of the two active surfaces 2, 3 is raised to a constant but non-uniform electric potential. The patent application GB 2 249 995 A shows two different concepts following this idea. The first, in the diagram of FIG. 4, operates two plane metallic electrodes 2, 3 between which a potential difference Vd is created. On one, 3, of these electrodes 2, 3 a part 18 made out of a dielectric substance is added, whose shape is similar to that of a portion of an elliptic cylinder. A curved face 19 of this part is placed facing the jet 1 and constitutes the active surface of the deflection device on which the electric potential is not uniform. The permittivity of the dielectric substance being known—and greater than that of air—it is suggested in the document to adjust the curve of the part 18 in such a way as to follow simultaneously the trajectory of the most highly charged drops and to obtain an optimum value of Ed at any point comprised between the two active surfaces of the device.

The implementation of this device brings up problems:

- cost the supplementary part 18 of complex shape and with a very good surface appearance is necessary;
- manufacturing: as well as respecting the dimensional tolerances, the transfer of the dielectric part 18 requires gluing resistant to ink sprays.
- operation: the active surface 19 of the dielectric part 18 does not permit the evacuation of parasitic electric charges coming from the ambient gaseous medium or the ink droplets accidentally projected on the wall. The accumulation of these electric charges rapidly leads to strong degradation of the field strength Ed.

A variant, proposed in the U.S. Pat. No. 4,845,512 A, consists of replacing the dielectric substance by an electret in order to be independent from the voltage generator creating the potential difference Vd. This concept remains subject to the same criticisms as the others mentioned above.

The second concept presented in the patent GB 2 249 995 A suggests the use of a resistive substance for forming the active face of one of the two electrodes of the deflection device. It is suggested that one should obtain, through careful alimentation of this electrode at its two extremities, a variation of electric potential along its active surface. This non-uniformity should then generate a deflection field Ed such that its value would be approximately optimum at each of the points comprised between the two active surfaces of the device. This solution is criticised in said patent GB 2 249 995 A by emphasising the high current consumption—and therefore the high heat emission—which its implementation would induce.

Patent FR 97 06799 includes an analysis and detailed appraisal of the above proposals. This document insists essentially on describing a non-equipotential device exempt from the operational difficulties described above. To this effect, at least one of the two active surface is made under the form of an insulating substrate on which is deposited, according to the height of this surface, a plurality of electrodes connected to different voltage sources. A resistive coating covers the insulating substrate and the electrodes. Careful choice of the number of electrodes, of the value of the voltages applied and of the value of the sheet resistance of the resistive coating makes it possible to create an optimum field Ed over the whole height of the deflection device while still minimising and controlling the electric currents and the parasitic heat fluxes.

The major handicap of such a device resides in its complexity of production and its manufacturing cost.

To resume, the deflection devices representative of prior art and implemented in ink jet printers are characterised as follows:

equipotential way: simple concept but poor deflection efficiency.

non-equipotential way: increased deflection efficiency but implementation difficult because of the manufacturing costs and the operational principles adopted.

BRIEF DESCRIPTION OF THE INVENTION

Compared to the state of the art described above, the aim of the present invention relates to producing an electrostatic deflection device that can be integrated into a printing head of an ink jet printer, and whose efficiency equals or exceeds that of non-equipotential designs for significantly lower production costs, by means of an arrangement of deflection electrodes whose active surfaces are raised to uniform electric potentials.

Another aim of the present invention is to constitute an arrangement of deflection electrodes with reduced overall dimensions and leading to a reduction of the overall dimensions of a printing head of a printer in which this head is incorporated.

Another aim of the present invention is to obtain deflection performances with a voltage that is significantly lower than the usual voltages feeding equipotential deflection electrodes and thus facilitating integration of said electrodes and a generator of said lower voltage in a printing head.

A further aim of the invention is to reduce significantly the risk of accidental projection of ink on the active surface of the deflection electrodes.

For all these purposes, the invention relates to a printing head for a continuous ink jet printer equipped with means for generating an ink jet according to an axis of the ink jet, from at least one ejection nozzle of the jet, and for splitting the jet into a series of drops, means for charging the different drops in the series of drops in a selective way, and deviation electrodes for charged drops, deviating the drops in function of the value of the charge received, either towards a gutter for recuperating the drops, or to an impression substrate maintained locally by an impression substrate support, the deviation electrodes each having an upstream part and a downstream part relative to the ejection nozzle of the jet, an active surface of each deviation electrode being a surface of said electrode facing the series of drops, the printing head characterised in that the deviation electrodes of the drops of the jet comprise two electrodes, a first and a second, the active surface of the first electrode having a first concave longitudinal curvature whose local radius of longitudinal curvature is located in a plane formed by the axis of the ink jet and a deviation direction of the drops, in that the active surface of the second electrode has a first convex longitudinal curvature and in that the first electrode has a recess with a border in its downstream part.

The meaning of downstream part will now be explained. The function of the recess is to allow the passage of non-deviated or slightly deviated drops through the first electrode. The non-deviated drops then closely follow a trajectory which, as a first approximation, can be considered as rectilinear. The result of this is that the most upstream part of the recess border will be located immediately next to and slightly upstream of the point of intersection of the first electrode with the axis of the jet. The most upstream part of the border of the recess must therefore be located at a sufficient distance from the point of intersection of the first electrode with the jet axis so that a non-deviated drop can pass through the recess in the electrode with a quasi-zero probability of intercepting the electrode.

The slightly charged and thus slightly deviated drops have a trajectory whose curvature can be lower than that of the first electrode. The trajectory of the slightly deviated drops is therefore likely to be secant at the active surface of the first electrode. The recess must be such that it allows the passage of these slightly deviated drops. The possible point of intersection of the trajectory of a little-deviated drop and the surface of the electrode before the recess is necessarily located downstream of the point defined above as being the most upstream point of the recess. It can thus be considered that the downstream part of the first electrode is a part of this electrode located downstream of the point of intersection of the electrode and the axis of the jets.

Given the function of the recess, it can also be understood that the shape of this recess will be such that its line of symmetry is a line defined by the intersection of the electrode before the recess, with a plane containing the axis of the jets and the direction of deviation of the drops. The recess will thus have an oblong shape centred on the line of symmetry defined above.

The width of the recess results from a compromise between two demands, letting the drops pass through the first electrode without risk of collision between the drop and the electrode, which means that the recess should be wide, and not reducing too much the inter-electrode field, which means that the recess should be narrow.

The diameter of the drops of ink is of the order of several tens of $\mu$m, typically comprised between 30 and 140 $\mu$m, for example 100 $\mu$m.

The width measured perpendicular to this line is greater than the diameter of the drops and ideally of the order of two to three times the diameter of the drops, that is typically 200 to 300 $\mu$m. However, to be certain of avoiding collisions between drops and the first electrode, one may have to set a width of the order of 8 to 10 times the diameter of the drops.

Thus the embodiments of the invention can, together or separately, present the following characteristics.

The curvature of the second electrode is such that the active surface of the second electrode is substantially parallel to that of the first electrode so that the two active surfaces have a closely constant spacing e between them.

The border of the recess has a highest upstream point located in the neighbourhood of the intersection, before the recess, of the first electrode with the axis of the ink jet.

The recess has a symmetry relative to a plane containing the axis of the ink jet.

The recess has a width comprised between two and ten times the diameter of the ink drops.

The recess has the shape of an oblong slit with one opening extending onto the most downstream part of the first electrode.

The spacing between the active surfaces of the two electrodes is substantially constant from the upstream to the downstream of the electrodes and comprised between 4 and 20 times the diameter of the ink drops, that is between about 0,5 and 3 mm.

A most downstream edge of the first electrode is closer to the printing support than a most downstream surface of the recuperation gutter.

The second electrode is provided, from its active surface, with a groove traced according to an axis contained in a plane containing the axis of the jet.

A base of the groove is connected to the active surface of the second electrode by a surface curved transversally according to curvature radii of a value greater than the radius of the ink drops.

The tongues of the first electrode formed on either side of the recess and the second electrode are curved transversally according to the curvature radii with a value greater than the radius of the ink drops.

BRIEF DESCRIPTION OF THE DRAWINGS

An example of an embodiment and variants, together with the operation of a printing head having electrodes presenting the characteristics of the invention, will now be described with reference to the attached drawings in which:

FIG. 5 part A is a front view of electrostatic deflection electrodes produced according to the invention. FIG. 5 part B shows a view from the left of the diagram shown in FIG. 5 part A;

FIG. 6 comprises a part A and a part B. Parts A and B each show a transversal cross-section of electrostatic deflection electrodes produced according to a variant of the invention;

FIGS. 1 to 4 related to prior art have already been described.

DESCRIPTION OF EMBODIMENT EXAMPLES

In the description below the elements having the same function according to prior art or to the present invention carry the same reference number.

Figure 1:
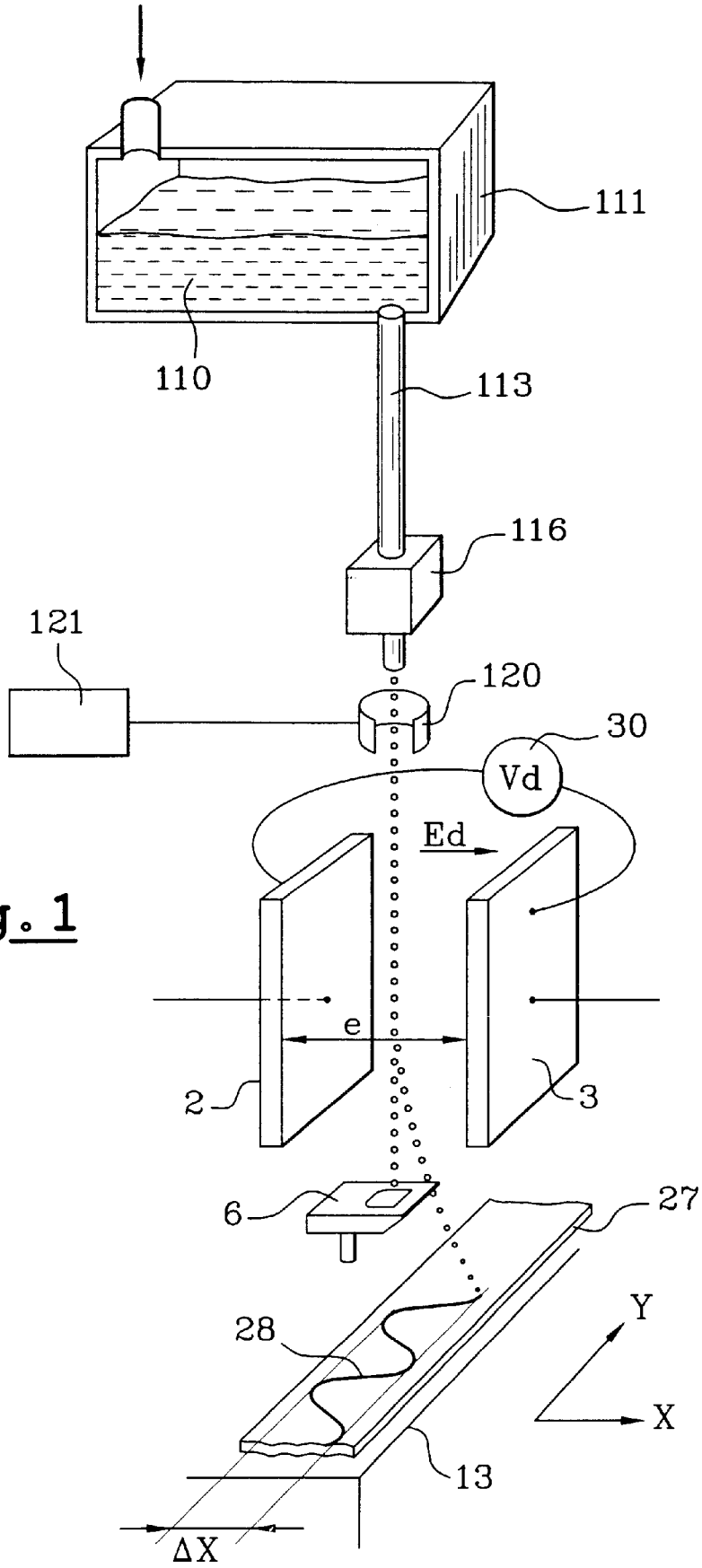
FIG. 1 shows diagrammatically a printing head comprising equipotential deflection electrodes according to prior art.
Figure 3:
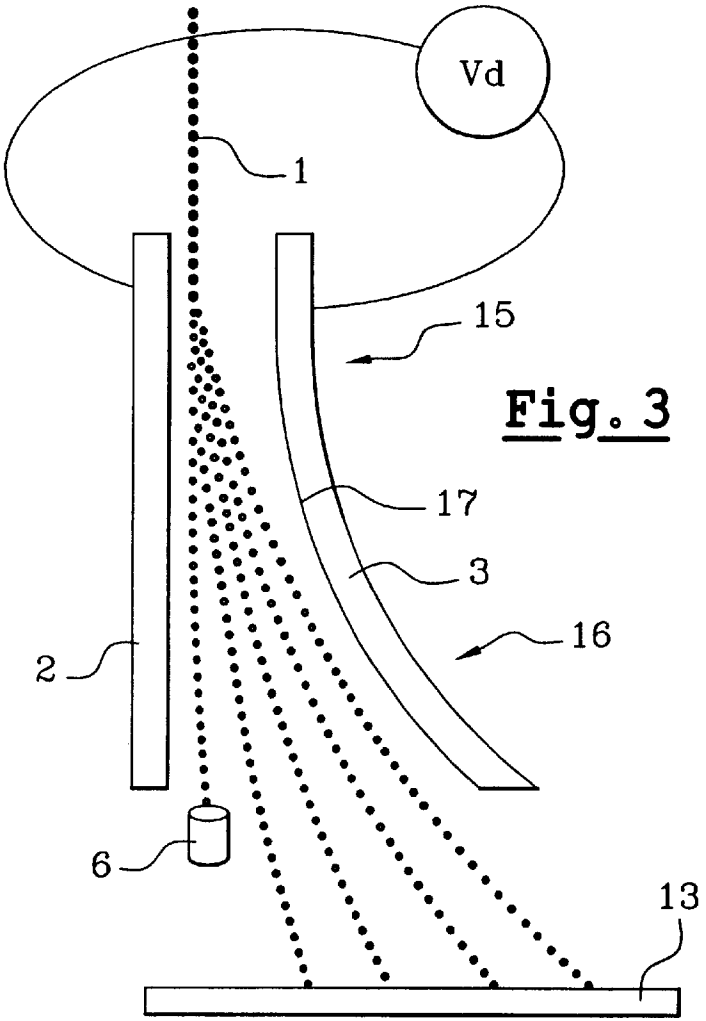
FIGS. 2 and 3 are diagrams of equipotential deflection electrodes of a printing head according to prior art.
Figure 2:
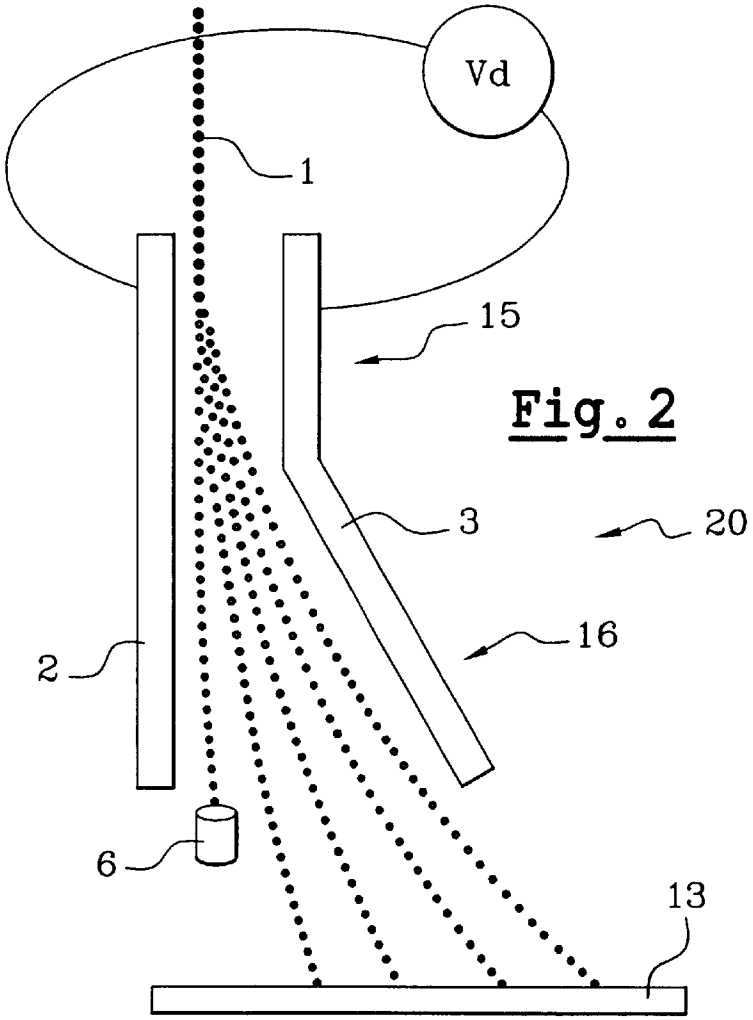
Figure 4:
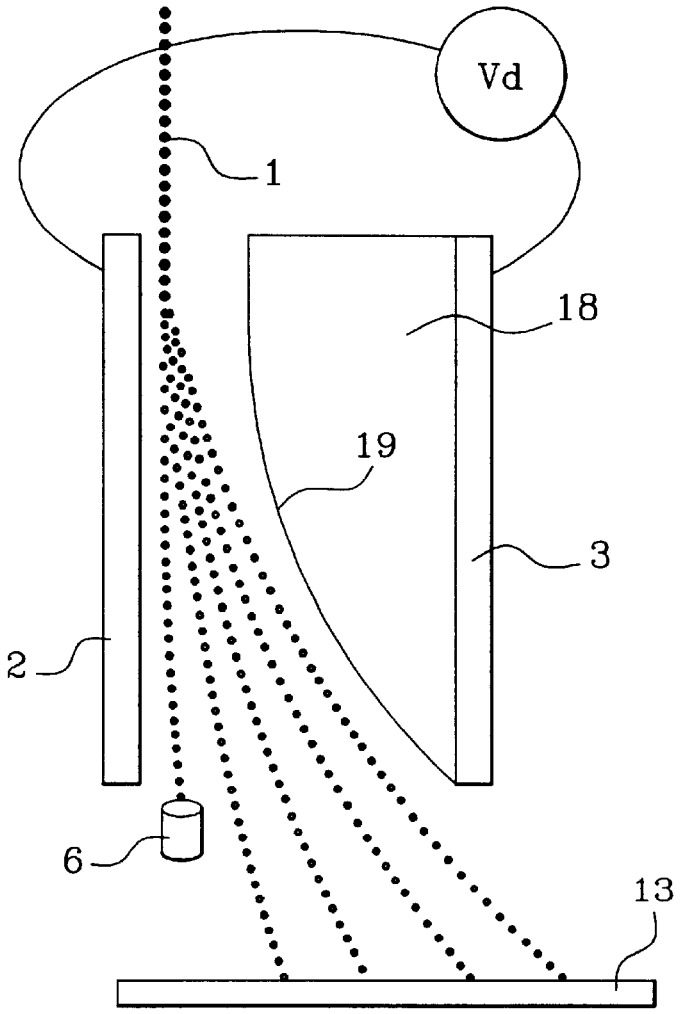
FIG. 4 is a diagram of non-equipotential deflecting electrodes for a printing head according to prior art.
Figure 5:
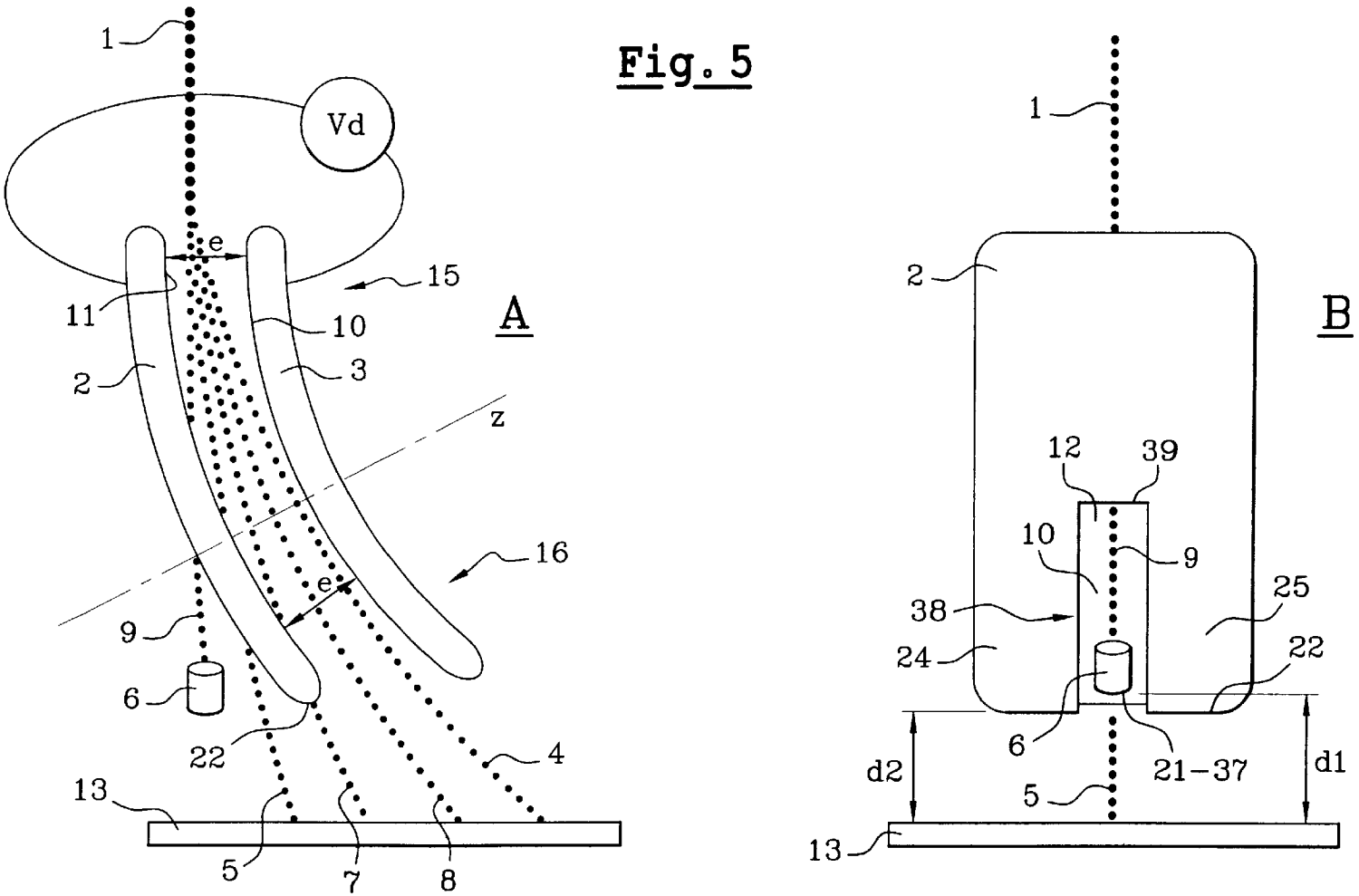
FIG. 5 comprises a part A and a part B.
Figure 7:
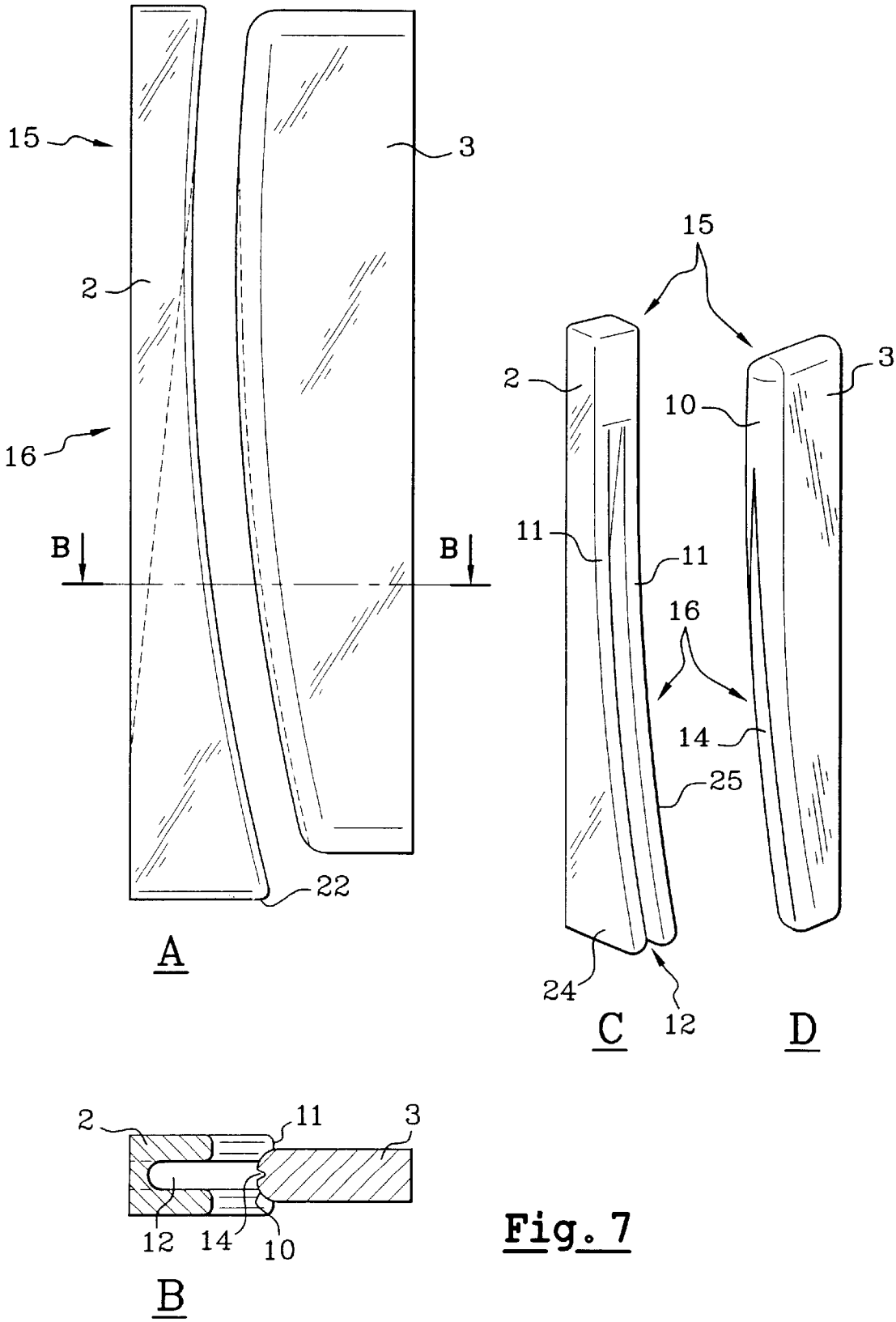
FIG. 7 comprises parts A, B, C and D. Part A shows a view in perspective, seen from the side, of an ensemble of two electrodes according to the invention. Part B shows a cross-section of the two electrodes along the line B—B of part A. Part C is a view in perspective of an electrode split according to the invention. Part D shows a view in perspective of the convex electrode intended to demonstrate a surface indentation.

FIG. 5, parts A and B, are respectively a diagrammatic view from the front and from the left illustrating a particular embodiment mode for electrostatic deflection electrodes according to the invention, implemented within a printing head with single-nozzle deviated stimulated continuous jet. FIG. 6 parts A and B, are respectively cross-sections made at the level of the axis Z of FIG. 5 part A, for two embodiments. These figures are intended to explain the invention and its operation. FIG. 7 is intended to demonstrate, in more realistic fashion the shape of the electrodes in a particular embodiment mode. In FIGS. 5 to 7, only the elements related to the electrodes, the subjects of the invention, are shown. The other constituents of the printing head are known to those skilled in the art and their description as illustrated in relation to prior art, for example in FIG. 1, is sufficient for clear understanding of the present invention.

A series of selectively charged drops 1 penetrates the space defined by the electrodes 2 and 3 between which there is a potential difference Vd provided by a voltage generator 30. The electrodes 2 and 3 are closely equal in height. A plane tangent to the electrodes 2 and 3 respectively in their most upstream part is parallel to the axis of the jets or secant to this axis at a small angle.

The active surface 11 of the first electrode 2 has a concave longitudinal curvature substantially the opposite of that of the active surface 10 of the second electrode 3. An active surface 10 of the electrode 3 has a convex longitudinal curvature such that this surface is in a downstream part, substantially parallel to a trajectory 4 of the most deviated drops, represented by a dotted line. As known in the present state of the art, a trajectory can be visualised by stroboscopic illumination of the drops.

The spacing e, separating surfaces 10 and 11, is substantially constant along all the height of the electrodes 2, 3. The value of the spacing e is less than 3.5 mm and preferably lower than 2 mm. In order to avoid disturbing the trajectories of the less charged drops, a recess 12, which in the example shown has the shape of a slit 12 to be seen in part B of FIG. 5 and B and C of FIG. 7, is made in the downstream part of the electrode 2. The width of the recess 12 is greater than the diameter of the ink drops. In practice, advantageously one limits the width of the recess 12 in such a way that the fall in the value of the field Ed existing in the downstream part of the electrodes 2, 3 does not exceed 15% of that of the optimum field created in its upstream part.

The electrodes 2 and 3 are preferably made out of an unoxidizable metal.

The longitudinal curvature of the electrodes is preferably constant, such that the active surfaces of the electrodes 2, 3 are formed substantially by cylindrical surface parts with axis perpendicular to the axis of the jet.

The operation is as described below.

The electric field Ed resulting from the potential difference Vd deviates the ink drops proportionally to their electric charge along predetermined trajectories. Trajectory 4 is that followed by the drops carrying the maximum charge Qmax. This is thus the trajectory for the most deviated drops. The active surface of the second electrode 3 is calculated such that the probability of the trajectory 4 meeting the second electrode is quasi-zero, even though the trajectory 4 is parallel and close to the active surface of the second electrode 3, at least in the downstream part of this surface. Trajectory 5 is that followed by the drops with minimum charge Qmin making it possible to avoid the recuperation gutter 6 and thus to be directed towards the printing substrate. The drops carrying electric charges comprised between the values Qmax and Qmin follow intermediate trajectories such as, for example, the trajectories 7 or 8. Trajectory 9 corresponds to that of drops with a quantity of charge lower than Qmin: such drops are caught by the recuperation gutter 6 and recycled towards an ink circuit of the printer.

Slit 12 shown in FIG. 5 part B and FIG. 7 parts B and C is, as explained above, such that the least deviated drops and in particular those with charge lower than Qmin pass through this slit. As explained above, it results that the most upstream part 39 of the border 38 of this slit 12 is placed in a location close to the point of intersection of the jet axis with the first electrode 2. Since the drops with charge lower than Qmin and the less charged drops among those with charges between Qmin and Qmax pass through the slit 12 of the electrode 2, the dispersion of the drops can be conserved despite a spacing e between the electrodes 2 and 3 reduced relative to the electrodes of prior art.

The small spacing e allows the use of a value of Vd of the order of 3 kV instead of the 8 to 10 kV usually used in devices with equipotential electrodes according to prior art. It is therefore particularly advantageous to produce the potential difference Vd by raising the electrode 2 to the reference potential of the ink, usually the potential of the printer mass. Under these conditions, contrary to prior art where this potential is a potential opposed to that of the electrode 3, relative to the ink potential, it becomes possible to approach or even to integrate the recuperation gutter 6 and the electrode 2 without risk of electrical breakdown between these two elements and without tampering with the field Ed between the two electrodes.

Under these conditions the distance d1 between the lower edge 21 of the gutter 6 and the printing support 13 can become greater than the distance d2 separating the downstream extremity 22 of electrodes 2, for this same printing support 13. Thus one obtains a significant reduction of the path followed by the drops directed towards the gutter 6 and thus a reduction of the probability that these drops miss this gutter.

Parts A and B of FIG. 6 and part D of FIG. 7 each show an advantageous embodiment of electrodes 2 and 3. Each of these embodiments is shown, FIG. 6 by a large scale cross-section made approximately following the plane z defined in FIG. 5 part A. The shape of these curves can characterise, along all their height or at least in a downstream part, the active faces 10 and 11.

These cross-sections are carried out downstream of the most upstream point of the recess 12 shown on FIG. 5 part B. In FIG. 5 part B and in FIG. 7 part C, one sees that the recess 12 separates the electrode 2 into two tongues 24 and 25 respectively. FIG. 6 is intended to show that advantageously the tongues 24, 25 and the electrode 3 facing them have transversal curvatures. These transversal curvatures are also visible in FIG. 7.

The aim of the transversal curvatures illustrated in FIG. 6 part A is to eliminate any metallic sharp edge or unevenness which could cause an electric discharge phenomenon which could lead to a lowering of the field Ed or to an electrical breakdown. The radius of the transversal radius of the surface 11 of the tongues 24, 25 and the electrode 3 is greater at any point than that of the ink drops.

FIG. 6 part B shows an electrode 2 with the same characteristics of transversal curvature as the electrode 2 shown in part A. According to the embodiment variant shown in part B, the active surface 10 of the electrode 3 is also provided with a transversal curvature with the same capacities as electrode 3 shown in part A, to reduce the appearance of electric discharges.

In addition, the electrode 3 has an indentation or longitudinal groove 14. This indentation can extend along the whole height of surface 10 or on a downstream part only as shown in FIG. 7 parts A and D. The indentation 14 is located transversally with respect to the recess 12 of the electrode 2. The width of the indentation 14 is greater than the diameter of the ink drops but remains sufficiently fine so as to avoid changing the field Ed significantly from its optimum value.

Such an indentation is especially useful for avoiding certain ink projections on the surface 10. In fact, in the hypothesis that the ratio electric charge to mass of certain drops is badly controlled and exceeds a predetermined maximum value, these drops follow an erroneous trajectory 35 and:

- penetrate the indentation 14 without colliding with the surface 10,
- being submitted, in the indentation 14, to the action of a very weak electric field. This fall in the field value provokes a modification of the erroneous trajectories in such a way as to approach them, when leaving the deflection device, to the trajectory 4 of the most deviated drops, whose charge to mass ratio respects the predetermined maximum value. Thus these drops, even with their erratic trajectory, do not collide with electrode 3. As a result, the electrode 3 remains clean which means that it is not deformed by the presence of ink on the electrode. Consequently, the following drops will not be subject to deformation of their trajectory due to the possible presence of a drop from an erratic trajectory. This arrangement also has the advantage of facilitating the voltage settings to be applied to the electrodes for starting up the printer.

The advantages of the inventions over prior art are clear:

- simplicity of design and efficiency of deflection are produced at the same time;
- protection against certain projections of ink on the electrodes by adjusting the geometry of at least one active surface.

The low value of Vd as well as the high positioning of the recuperation gutter 6 allow a significant reduction of the overall dimensions of the printer head and the path followed by the ink drops. As a result, the parasitic variations of the trajectories of the drops are low in amplitude, and the printing quality is higher.

What is claimed is:

1. A printing head for a continuous ink jet printer equipped with means for generating an ink jet according to an axis of the ink jet, from at least one ejection nozzle of the jet, and for splitting the jet into a series of drops, means for electrically charging the different drops in the series of drops in a selective way, and deflection electrodes for charged drops, deviating the drops in function of the value of the charge received, either towards a gutter for recuperating the drops, or to a printing substrate maintained locally by a printing substrate support, of the printing substrate, the deflection electrodes each having an upstream part, and a downstream part relative to the ejection nozzle of the jet, an active surface of each deflection electrode being a surface of said electrode facing the series of drops, the printing head characterised in that the deflection electrodes of the drops of the jet comprise two electrodes, a first and a second, the active surface of the first electrode having a first concave longitudinal curvature whose local radius of longitudinal curvature is located in a plane formed by the axis of the ink jet and a deviation direction of the drops, in that the active surface of the second electrode has a first convex longitudinal curvature and in that the first electrode has a recess with a border in its downstream part.

2. Printing head according to claim 1 characterised in that the border has a highest upstream point located next to the intersection before the recess of the first electrode with the ink jet axis.

3. Printing head according to claim 1 characterised in that the recess presents a symmetry relative to a plane containing the axis of the ink jet.

4. Printing head according to claim 1 characterised in that the recess has a width comprised between 4 and 20 times the diameter of the drops of ink.

5. Printing head according to claim 1 characterised in that the recess has the shape of an oblong slit with one opening extending into the part (22) the most downstream of the first electrode.

6. Printing head according to claim 1 characterised in that the spacing between the active surface of the two electrodes is substantially constant from upstream to downstream of the electrodes and comprises between 4 and 20 times the diameter of the drops of ink.

7. Printing head according to claim 1 characterised in that an edge the most downstream of the first electrode is closer to the printing support than a surface the most downstream of the recuperation gutter.

8. Printing head according to claim 1 characterised in that the second electrode has a groove according to an axis contained in a plane containing the axis of the jet.

9. Printing head according to claim 8 characterised in that a base of the groove is connected to the active surface of the second electrode by a surface curved transversally according to curvature radii of value greater than the radius of the drops of ink.

10. Printing head according to claim 1 characterised in that the tongues of the first electrode formed on either side of the recess and the second electrode are curved transversally according to curvature radii of value greater than the radius of the drops of ink.

11. Printer characterised in that it is equipped with a printing head according to one of the preceding claims.

12. Printing head according to claim 2 characterized in that the recess presents a symmetry relative to a plane containing the axis of the ink jet.

* * * * *